US005638961A

United States Patent [19]

Satake et al.

[11] Patent Number: 5,638,961

[45] Date of Patent: Jun. 17, 1997

[54] CEREAL GRAIN COLOR SORTING APPARATUS

[75] Inventors: Satoru Satake, Tokyo; Takafumi Ito, Mihara; Norimasa Ikeda, Hiroshima, all of Japan

[73] Assignee: Satake Corporation, Tokyo, Japan

[21] Appl. No.: 388,152

[22] Filed: Feb. 13, 1995

[51] Int. Cl.[6] ..... B07C 5/342

[52] U.S. Cl. ..... 209/580; 209/581; 209/639; 209/644

[58] Field of Search ..... 209/581, 580, 209/577, 639, 644

[56] References Cited

U.S. PATENT DOCUMENTS

| | | | |
|---|---|---|---|
| 3,675,769 | 7/1972 | Story . | |
| 3,800,147 | 3/1974 | Shea et al. | 250/564 |
| 3,890,221 | 6/1975 | Muehlethaler . | |
| 3,930,991 | 1/1976 | Gillespie | 209/3 |
| 4,088,227 | 5/1978 | Lockett . | |
| 4,096,949 | 6/1978 | Hoover et al. . | |
| 4,146,135 | 3/1979 | Sarkar et al. | 209/580 |
| 4,168,005 | 9/1979 | Sandbank | 209/552 |
| 4,186,836 | 2/1980 | Wassmer et al. | 209/565 |
| 4,203,522 | 5/1980 | Fraenkel et al. | 209/581 X |
| 4,235,342 | 11/1980 | Braham | 209/564 |
| 4,344,539 | 8/1982 | Lockett | 209/564 |
| 4,454,029 | 6/1984 | Codding | 209/581 |
| 4,513,868 | 4/1985 | Culling et al. | 209/581 |
| 4,699,273 | 10/1987 | Suggi-Liverani et al. | 209/580 |
| 4,940,850 | 7/1990 | Satake | 209/580 |
| 5,135,114 | 8/1992 | Satake et al. | 209/558 |
| 5,265,732 | 11/1993 | Long | 209/580 |
| 5,487,472 | 1/1996 | Satake et al. | 209/581 |

FOREIGN PATENT DOCUMENTS

| | | |
|---|---|---|
| 1-258781 | 10/1989 | Japan . |
| 5-200365 | 8/1993 | Japan . |

*Primary Examiner*—David H. Bollinger
*Attorney, Agent, or Firm*—Darby & Darby

[57] ABSTRACT

In a color sorting apparatus comprising: a grain guide device); a grain feed device; optical detecting devices including illuminating devices for illuminating the grain, light-receiving sensors for receiving the intensity of light from the illuminated grain and backgrounds; and an ejector device for removing the grain, the illuminating devices comprise first light sources having a spectral energy distribution in a visible light region and second light sources having a spectral energy distribution in a near-infrared region, and the light-receiving sensors comprise a first light-receiving sensor portion having a high sensitivity to light in the visible light region and a second light-receiving sensor portion having a high sensitivity to light in the near-infrared region, so as to detect and remove foreign matter having a different color from the good grain in visible light region as well as to separate and remove other foreign matter having the same color as the good grain or being transparent in near-infrared region with one color sorting apparatus.

5 Claims, 4 Drawing Sheets

CEREAL GRAIN COLOR SORTING APPARATUS

BACKGROUND OF THE INVENTION AND RELATED ART

The present invention relates to a cereal grain color sorting apparatus which optically detects foreign matter mixed in the grains such as rice grains, wheat grains or beans or bad one of the grains mixed therein so as to sort or discriminate and remove the same.

In this specification, "color" of the granular object generally means "the color in visible light region", and the granular object being "transparent" means that, so far as there is no other prescription, "it is transparent to visible light", that is, "it has the property of transmitting therethrough the visible light".

As disclosed in Japanese Patent Unexamined Publication No. 1-258781, for example, in conventional color sorting apparatus, the grain is illuminated with a light source such as incandescent lamp, fluorescent lamp or the like in the visible light region, a difference between an intensity of light from the grain illuminated with the light source and an intensity of light from a background serving as a reference color board is detected by light-receiving elements dedicated to a plurality of wavelength bands in the visible light region respectively, thereby discriminating and removing the foreign matter by making use of a difference in color between good grain and foreign matter. However, in the above-described conventional color sorting apparatus, in the case that the foreign matter such as broken piece of glass, plastics, metal, pottery, china or the like, mixed in the cereal grain had the same color as the good grain or was transparent, appropriate separation and removal of the foreign matter could not be effected.

Japanese Patent Unexamined Publication No. 5-200365 discloses a foreign matter detecting apparatus in which near-infrared light is irradiated to a checking area, and two kinds of light of specific wavelengths (of about 1,300 nm and about 1,460 nm) in the near-infrared region (at wavelengths of 750~2,500 nm) are detected out of the light diffused by and transmitted through an object to be checked, and the detected two values are compared with respective predetermined values so as to decide whether the checked object is an desirable object such as white rice grain or a foreign matter such as glass piece or plastic piece, thereby detecting and discriminating from the good grain the foreign matter having the same color as the good grain or being transparent.

However, only with the above-described foreign matter detecting apparatus using the near-infrared light for the light source, bad or undesirable grain and the like cannot be sorted out from the good grain, and therefore, in order to effect discrimination and removal of the bad grain and the like as well, it is necessary to additionally equip the conventional color sorting apparatus using the visible light for the light source. Namely, effective sorting can be performed only in such a manner that ordinary foreign matter having a different color from the good grain is first discriminated and removed from the good grain in the visible light region by the conventional color sorting apparatus and, thereafter, other foreign matter having the same color as the good grain or being transparent is discriminated and removed from the good grain by the foreign matter detecting apparatus using light in the near-infrared light. On the other hand, to incorporate the foreign matter detecting apparatus disclosed in Japanese Patent Unexamined Publication No. 5-200365 in which the near-infrared light is used for the light source, into the conventional color sorting apparatus using light in the visible light region, will cause the apparatus to be too complicated and increased in size as a whole, resulting in that maintenance of the apparatus will be too troublesome.

SUMMARY OF THE INVENTION

In view of the above problems, an object of the present invention is to provide a cereal grain color sorting apparatus which is capable of, with one color sorting apparatus, detecting in visible light region, to discriminated and remove from good grain foreign matter having different color from the good grain as well as detecting in near-infrared region, to discriminate and remove from the good grain other foreign matter having the same color as the good grain or being transparent in the visible light region such as glass piece, plastic piece or the like.

According to the invention, the above object can be achieved by a cereal grain color sorting apparatus comprising: grain guide means for guiding the grain along a predetermined grain flow path to a predetermined detecting position; grain feed means for feeding the grain successively to the grain guide means; optical detecting means including illuminating means for illuminating the grain flowing down along the flow path through the predetermined detecting position, light-receiving sensor means for receiving an intensity of light from the illuminated grain and background means positioned oppositely to the light-receiving means with the grain flow path interposed therebetween; and ejector means, located below the optical detecting means, for serving to remove the grain, the intensity of light from which is different from an intensity of light from the background means, wherein the illuminating means comprises a first light source having a spectral energy distribution in a visible light region and a second light source having a spectral energy distribution in a near-infrared region, and wherein the light-receiving sensor means comprises a first light-receiving sensor portion having a high sensitivity to the light in the visible light region and a second light-receiving sensor portion having a high sensitivity to the light in the near-infrared region.

In the cereal grain color sorting apparatus according to the invention, because the illuminating means for illuminating the grain flowing down along the flow path through the predetermined detecting position comprises the first light source having the spectral energy in the visible light region and the second light source having the spectral energy in the near-infrared region, and because the light-receiving sensor means for receiving the intensity of light from the grain comprises the first and second light-receiving sensor portions having high sensitivities to the light in the visible light region and the near-infrared region, respectively, the grain passing through the detecting position can be illuminated by both of the visible light and the near-infrared light at a time, and the intensity of reflected light obtained by irradiation or illumination of the visible light and the intensity of reflected light obtained by irradiation of the near-infrared light can be detected separately by the first and second light-receiving sensor portions having high sensitivities for the wavelength bands of the visible light and the near-infrared light, respectively. Accordingly, it is possible with one color sorting apparatus to detect in the visible light region for separation and removal from the good grain the foreign matter having a different color from the good grain as well as to detect in the near-infrared region for discrimination and removal from the good grain the other foreign matter having the same color as the good grain or being transparent in the visible light region.

More detailed description will be made in the following.

Granular objects to be sorted are conveyed by the grain conveyor means so as to be fed along the predetermined flow path to the detecting position.

Each of the granular objects to be sorted, fed to the detecting position, is illuminated by the illuminating means comprising the first light source such as a fluorescent lamp of a luminous wavelength band of 350~700 nm and the second light source such as a halogen lamp of a luminous wavelength band of 500~2,000 nm. The intensity of light reflected from and transmitted through the granular object to be sorted illuminated by the first light source is detected by the first light-receiving sensor portion such as a silicon photosensor (through an optical filter which allows the light in the visible light region to be transmitted therethrough), and the intensity of light reflected from and transmitted through the granular object to be sorted illuminated by the second light source are detected by the second light-receiving sensor portion such as a germanium photosensor (through an optical filter which allows the light in the near-infrared region to be transmitted therethrough).

Further, the light-receiving sensor portions are irradiated with the light reflected from the backgrounds disposed oppositely to the respective light-receiving sensor portions.

If the intensity of light reflected from the background disposed oppositely to the first light-receiving sensor portion is adjusted beforehand so as to coincide with the intensity of light from the desirable good grain (white rice, for example), the intensity of light received by the first light-receiving sensor portion (through the optical filter) and the output signal from the first light-receiving sensor portion are not changed even when the good grain passes through the detecting position. However, when the granular object or foreign matter having a different color from the good grain passes through the detecting position, the intensity of received light and the output signal are changed, so that the ejector means is operated in response to the output signal to induce the granular object or foreign matter of different color to the other flow path.

Even in a case that the intensity of light received by the first light-receiving sensor portion and the output signal from the same are not substantially changed, there is a possibility that the good grain is mixed with the foreign matter having the same color as the good grain or being transparent (such as broken piece of glass, plastics, metal, pottery, china or the like).

Meanwhile, the good grain, e.g. good white or whitened rice grain, absorbs the near-infrared light so that the reflectance thereof in the near-infrared region is low. However, the foreign matter such as the broken piece of glass, plastics, metal, china or the like does not absorb the near-infrared light so that the reflectance thereof in the near-infrared region is high.

In the case that the intensity of light received by the first light-receiving sensor portion and the output signal from the same are not substantially changed, the intensity of light received by the second light-receiving sensor portion and the output signal from the same are not substantially changed either even when the good grain (white rice) passes through the detecting position. However, when the foreign matter having the same color as the good grain or being transparent passes through the detecting position, the intensity of light reflected from the foreign matter and received by the second light-receiving sensor portion is changed, and accordingly, the output signal from the second light-receiving sensor portion is changed. In response to a change of the output signal from the second light-receiving sensor portion, the ejector means for inducing to the other flow path the foreign matter having the same color as the good grain or being transparent, is operated to effect the discrimination and removal of the foreign matter.

Then, the good grain such as white rice grain which does not cause any change in the intensities of light received by the first and second light-receiving sensor portions and the output signals from the same even when passing through the detecting position, is transferred to a receiving chute for receiving the good grain and discharged by a suitable conveyor means as a product.

According to a preferred embodiment of the invention, the first light source comprises a fluorescent lamp producing light in the visible light region, the second light source comprises a halogen lamp producing light in the near-infrared region, the first light-receiving sensor portion comprises a silicon photosensor and the second light-receiving sensor portion comprises a germanium photosensor.

In the cereal grain color sorting apparatus according to a preferred embodiment of the invention, because the first and second light sources comprise the fluorescent lamp suitable for the visible light region and the halogen lamp suitable for the near-infrared region, respectively, and because the first and second light-receiving sensor portions comprise the silicon photosensor having high sensitivity for the visible light region and the germanium photosensor having high sensitivity for the near-infrared region, respectively, ordinary foreign matter having a different color from the good grain can be discriminated in the visible light region and to be removed from the good grain while other foreign matter having the same color in the visible light region as the good grain or being transparent such as a broken piece of glass, plastics or the like can be discriminated in the near-infrared region and removed from the good grain, only by adding, in the conventional color sorting apparatus, the halogen lamps before and behind the detecting position and by exchanging one of the two light-receiving sensors provided before and behind the detecting position for the germanium photosensor. Accordingly, the cereal grain color sorting apparatus of the invention can be structurally simplified and reduced in size without increase in trouble of maintenance.

In the cereal grain color sorting apparatus according to a preferred embodiment of the invention, the first and second light-receiving sensor portions have filters which allow the light in the visible light region and the light in the near-infrared region to be transmitted therethrough, respectively. In the case that the granular object to be sorted as good grain is white rice grain or the like, it is preferred that the near-infrared filter of the second light-receiving sensor portion selectively allows the light of a wavelength band of 1,400~1,600 nm to be transmitted therethrough.

The foregoing and other objects, features and advantages of the invention will be made clearer from the description of preferred embodiments hereafter with reference to attached drawings

DETAILED DESCRIPTION OF PREFERRED EMBODIMENTS

Figure 1:
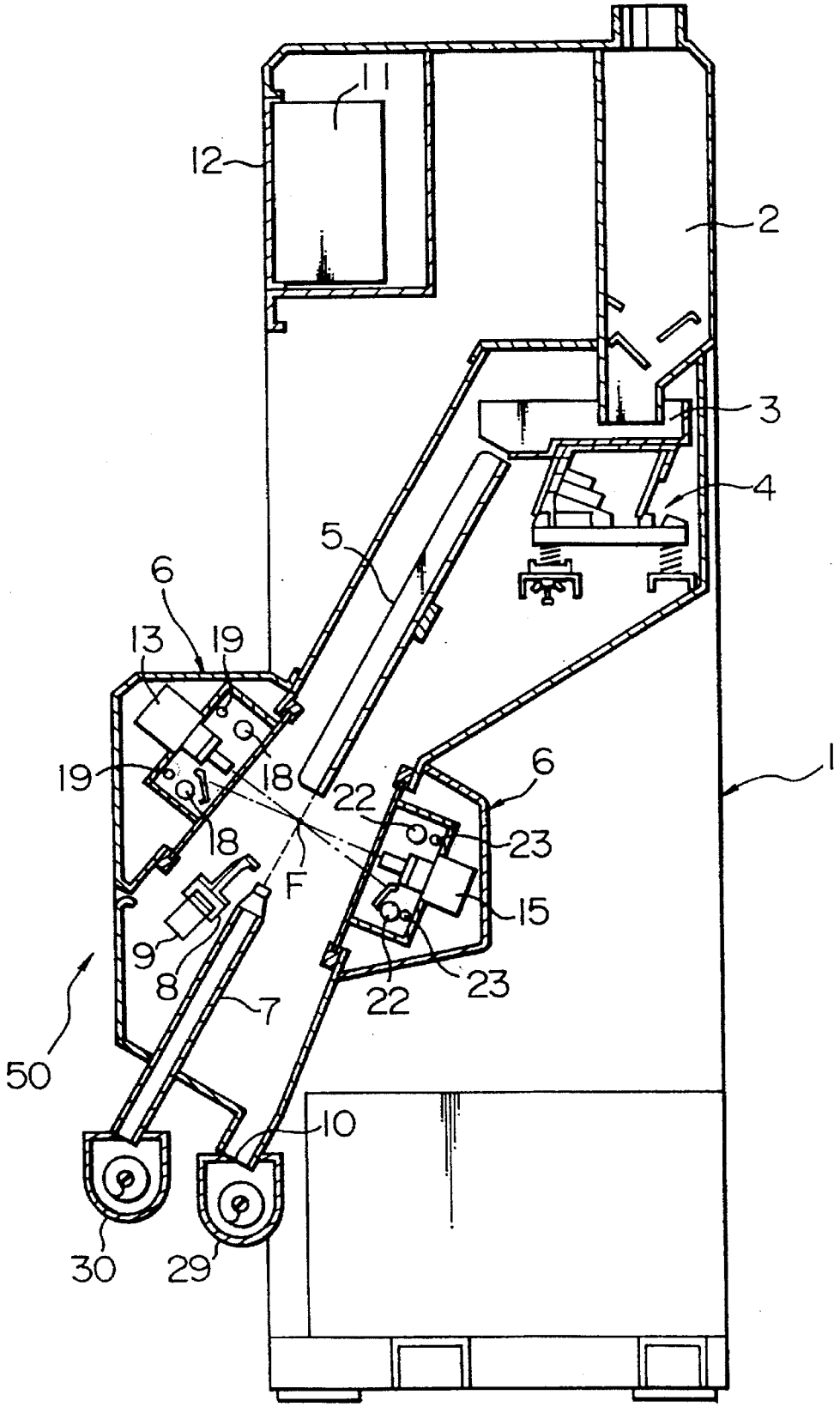
FIG. 1 is a side sectional view of a cereal grain color sorting apparatus according to a preferred embodiment of the invention.

Description will be given of preferred embodiment of the present invention with reference to the drawings, taking the case of sorting white or whitened rice grain for cereal grain. In FIG. 1, a raw grain tank 2 is provided at an upper portion of one side in a frame 1. At a lower end of the raw grain tank 2, a vibrating feed trough 3 is set on a vibration generating device 4 having components such as a vibrator. In this embodiment, the raw grain tank 2 and the vibrating feed trough 3 constitute the grain feeding means. The vibrating feed trough 3 is connected to an inclined downward chute 5 serving as the grain guide means. Namely, the downward chute 5 having a V-letter form cross-section is so disposed as to be close to an end of the vibrating feed trough 3 at an upper end thereof and face to a space between a pair of optical detecting portions 6 at a lower end thereof.

A hollow cylindrical receiving chute 7 is provided below the downward chute 5 so as to receive the rice grain, as the cereal grain or the desired granular object, falling down from the lower end of the downward chute 5. The receiving chute 7 is connected at a lower end thereof to a screw conveyor 30 serving as the conveyor means for discharging product. Further, in the vicinity of a detecting position F located on the way from the lower end of the downward chute 5 into the receiving chute 7, a nozzle exit of an ejector valve 8 is arranged for removing the undesired granular object or foreign matter, e.g. of different color, from the grain flowing down through the detecting position F. The ejector valve 8 is connected to an air compressor, which is not shown, through an air pipe 9. A reject or undesired granular object discharge port 10 is formed under the ejector valve 8, and a conveyor means 29 such as a screw conveyor for discharging the reject or undesired granular object is connected to the reject discharge port 10. In this embodiment, the ejector valve 8 with the nozzle exit, the air pipe 9 and the air compressor (not shown) constitute the ejector means. A control box 11 and a control panel 12 are provided at the upper portion of the frame 1.

Figure 4:
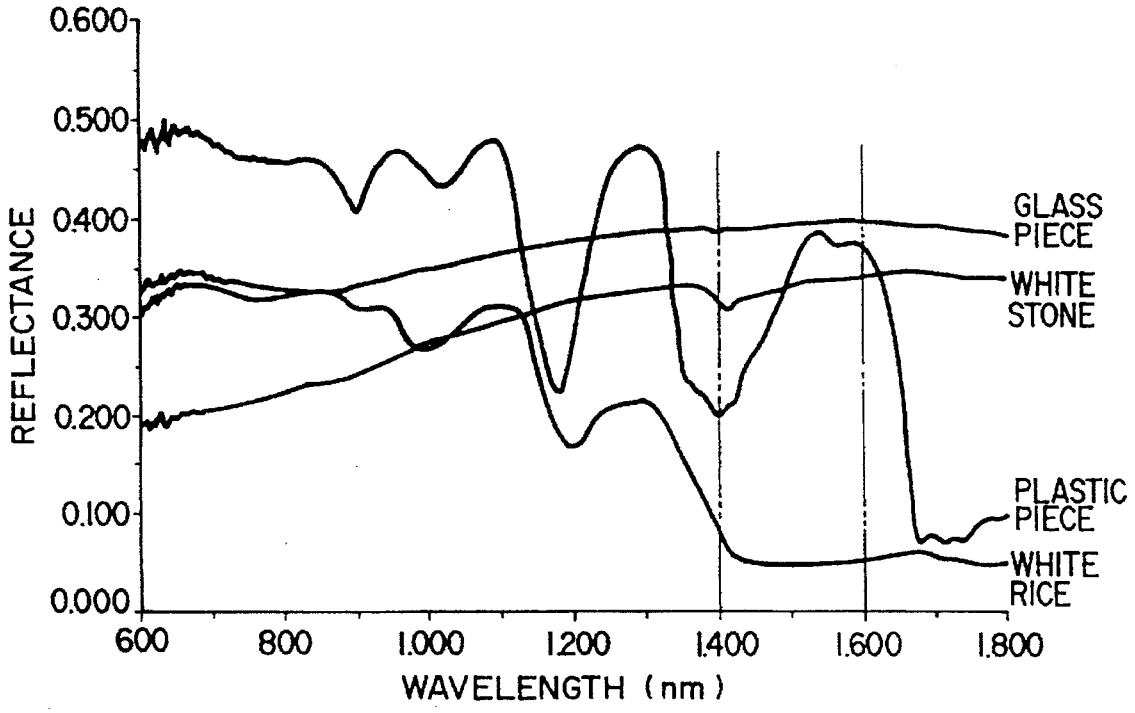
FIG. 4 is a graph showing reflected light intensity characteristics (wavelength-dependence of reflectance) of white rice, glass piece, plastic piece and white stone at wavelength bands from visible light region to near-infrared region.

Before explaining other portions of a cereal grain color sorting apparatus 50, reflectance characteristics of the grain which is the object to be detected and discriminated (selected) and of the foreign matter will be described. Comparing the good grain with the bad grain or foreign matter having a color different from the color of the good grain (in the visible light region), it is a matter of course that their reflectance characteristics in the visible light region (wavelength-dependence of reflectance) are different. On the other hand, as shown in FIG. 4, there are not so large differences in reflectance characteristics in the visible light region between the grain such as good rice grain and the foreign matters such as white stone and plastic piece which have the same color as the good grain in the visible light region and transparent glass piece, and however, there are large differences in reflectance characteristics in the near-infrared region of the wavelength band of about 1,400~1,600 nm, for example. Namely, as is apparent from FIG. 4, at the wavelength band of about 1,400~1,600 nm in the near-infrared region, the reflectance of the white rice grain is low but the reflectances of these possible foreign matters are higher.

Figure 2:
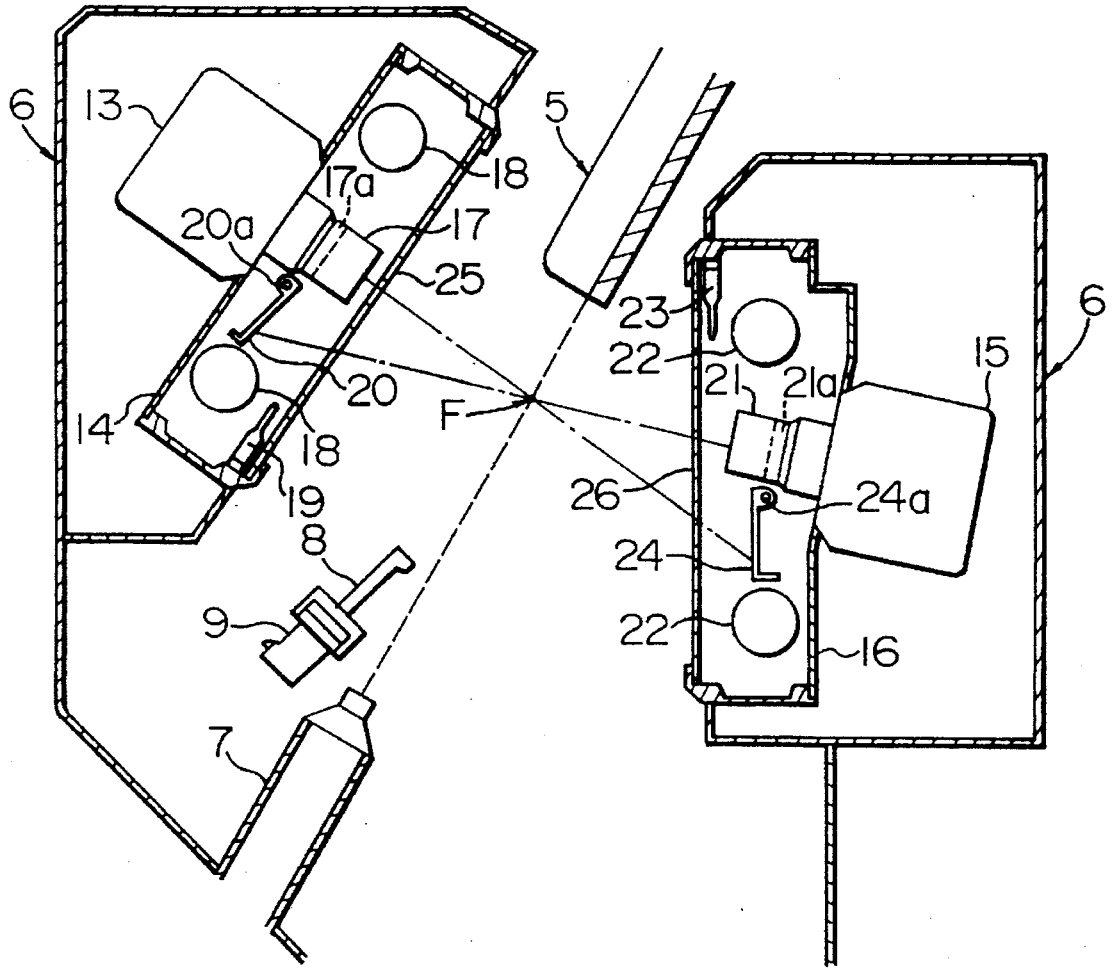
FIG. 2 is an enlarged sectional view of an optical detecting portion of the cereal grain color sorting apparatus of FIG. 1.
Figure 3:
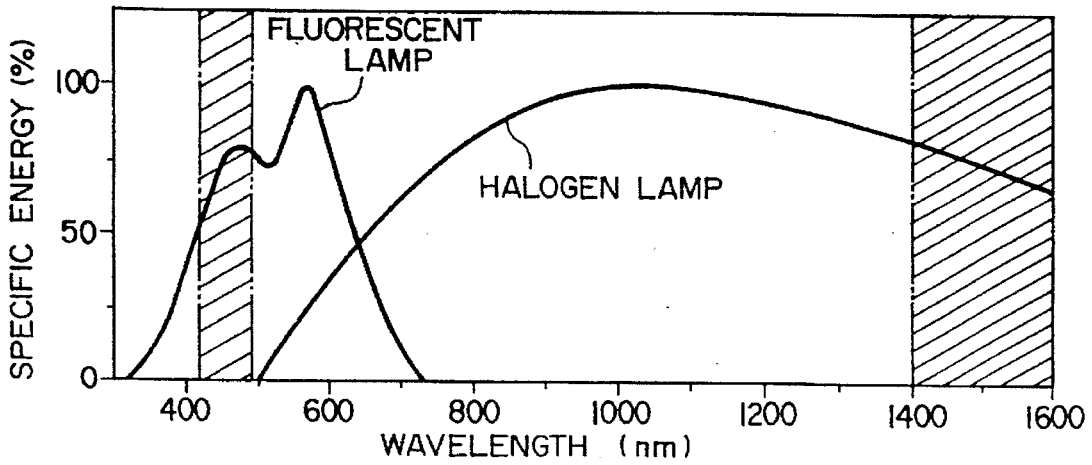
FIG. 3 is a graph showing spectral energy distributions of light sources used in the apparatus of FIG. 1.

Now, the optical detecting portion 6 for the optical detecting means will be described with reference to FIG. 2. The optical detecting portion 6 comprises an optical detection box 14 to which a silicon photosensor 13 for the first light-receiving sensor portion is secured, and an optical detection box 16 to which a germanium photosensor 15 for the second light-receiving portion is secured. The silicon photosensor 13 having a lens barrel 17 is inserted in and mounted to the optical detection box 14. Further, within the optical detection box 14 are provided a pair of fluorescent lamps 18 serving as the illuminating means or first light source for the silicon photosensor 13 having luminous or light-emission characteristics as shown in FIG. 3, a pair of halogen lamps 19 serving as the illuminating means or second light source for the germanium photosensor 15 and having luminous or light-emission characteristics as shown in FIG. 3 and a background 20 facing to the germanium photosensor 15. Likewise, the germanium photosensor 15 having a lens barrel 21 is inserted in and mounted to the optical detection box 16. Further, within the optical detection box 16 are provided a pair of fluorescent lamps 22 serving as the illuminating means or first light source for the silicon photosensor 13 and having the same luminous characteristics as the fluorescent lamp 18, a pair of halogen lamps 23 serving as the illuminating means or second light source for the germanium photosensor 15 and having the same luminous characteristics as the halogen lamp 19 and a background 24 facing to the silicon photosensor 13. The lens barrel 17 is provided with a filter 17*a* which allows the light in the visible light region to be transmitted therethrough, and the lens barrel 21 is provided with an optical filter 21a which allows the light in the near-infrared region to be transmitted therethrough. For the visible light-pass optical filter 17*a*, in order that the color of the grain can be distinguished between white and black only by the visible light, such a filter is suitably selected that allows the light of a wavelength band of 420~490 nm to be transmitted therethrough as shown by hatching in FIG. 3, for example.

On the other hand, for the near-infrared light-pass optical filter 21*a*, in order that the foreign matter which is hard to discriminate in the visible light region can be discriminated from the good grain, such an optical filter is suitably selected that allows the light of a wavelength band of 1,400~1,600 nm to be transmitted therethrough as shown by hatching in FIG. 3, for example. As is clear from FIG. 4, in the wavelength band of 1,400~1,600 nm, the reflectance of the white rice grain differs greatly from the reflectances of the white stone, plastic piece and transparent glass piece, so that the white rice grain can be discriminated from these foreign matters.

The background 24 is disposed in the optical detection box 16 so as to face to the silicon photosensor 13 with the detecting position F interposed therebetween and made of a glass plate or the like the surface of which exhibits a white color. A diffused reflection or transmission of light may be available. The fluorescent lamps 22 are disposed in the vicinity of the background 24 to illuminate the background 24 constantly. The background 24 is constructed such that an angle of rotation thereof about a shaft 24a or angle of inclination thereof with respect to the fluorescent lamp 22 is changed by a servo-motor (not shown) to vary the intensity of light, received thereby, from the fluorescent lamp 22. Likewise, the background 20 is disposed in the optical detection box 14 so as to face to the germanium photosensor 15 with the detecting position F interposed therebetween and made of a glass plate or the like the surface of which assumes a white color. The diffused reflection or transmission of light may be available. The halogen lamps 19 are disposed in the vicinity of the background 20 to illuminate the background 20 constantly. The background 20 is constructed such that an angle of rotation thereof about a shaft 20*a* or angle of inclination thereof with respect to the halogen lamp 19 is changed to vary the intensity of light, received thereby, from the halogen lamp 19.

The surfaces of the optical detection boxes 14 and 16, which face to each other, are formed by transparent glass plates 25 and 26, respectively, so as to prevent dust and the like from coming into the boxes 14, 16. The transparent glass plates 25, 26 may be provided with cleaning means (not shown) in which a cleaning member performs a reciprocating motion for the cleaning.

Figure 7:
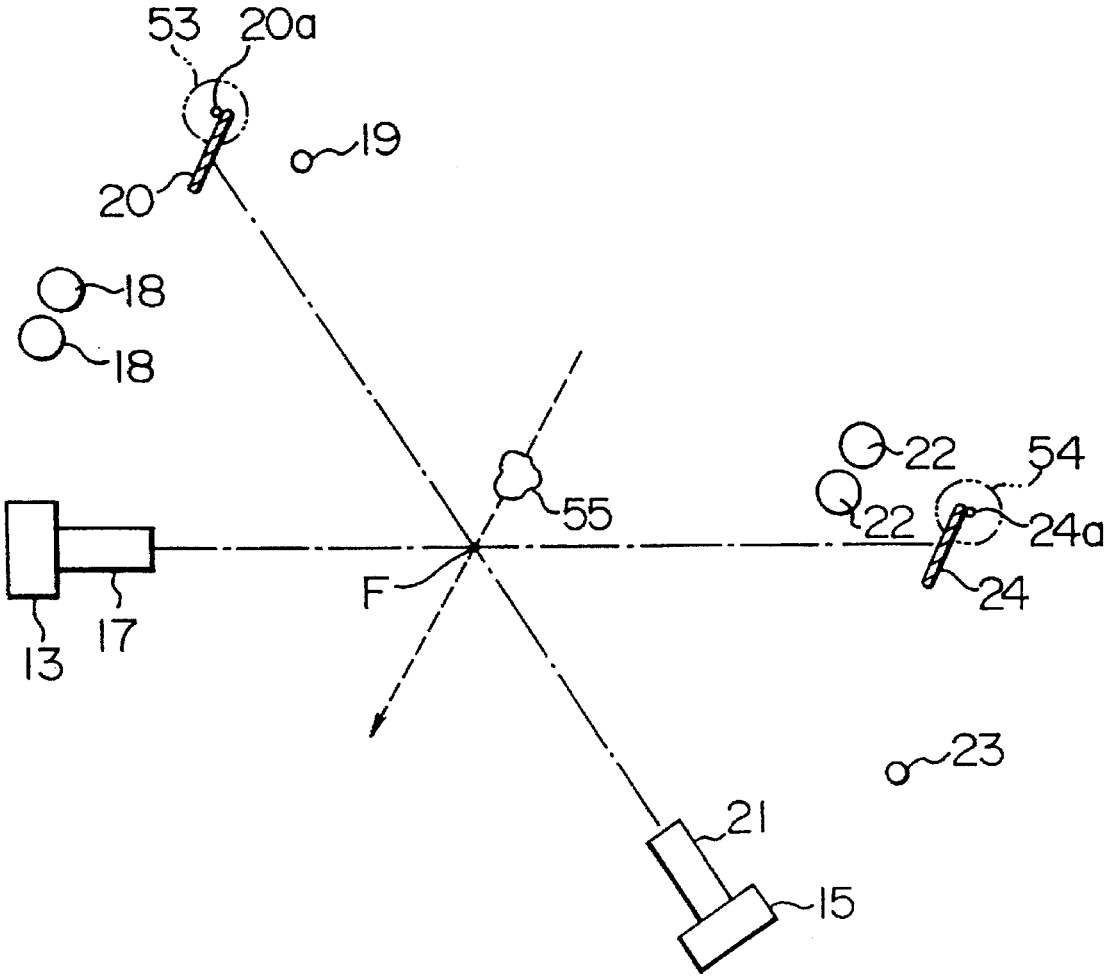
FIG. 7 is an illustration for explaining more detailed arrangement (positional relationship) of light sources, backgrounds and light-receiving sensors of the optical detecting portion of FIG. 2.

Further, a preferred relative arrangement of the light sources, the backgrounds and the light-receiving sensors is shown in more detail in FIG. 7 in the similar way to that of Japanese Patent Unexamined Publication No. 1-258781, for example. In FIG. 7, reference numerals 53, 54 denote servo-motors for rotating the shafts 20*a*, 24*a*, respectively, and 55 denotes a granular object to be sorted which is about to reach the detecting position F.

Figure 5:
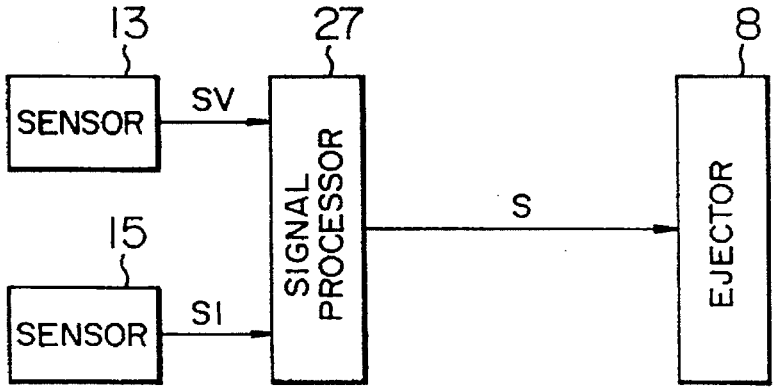
FIG. 5 is a block diagram a control portion for color discrimination and separation (removal) of the cereal grain color sorting apparatus shown in FIG. 1.

FIG. 5 is a block diagram showing components, for detection, discrimination and removal control, of the apparatus 50. Output signals SV, SI from the silicon photosensor 13 and the germanium photosensor 15 are sent to a signal processor 27 comprising an amplifier, a comparator, a calculation circuit and the like. A sorting or discrimination signal S from the signal processor 27 is sent to the ejector valve 8 to cause air to jet through the nozzle exit so as to separate or remove the grain of different color or foreign matter.

Figure 6:
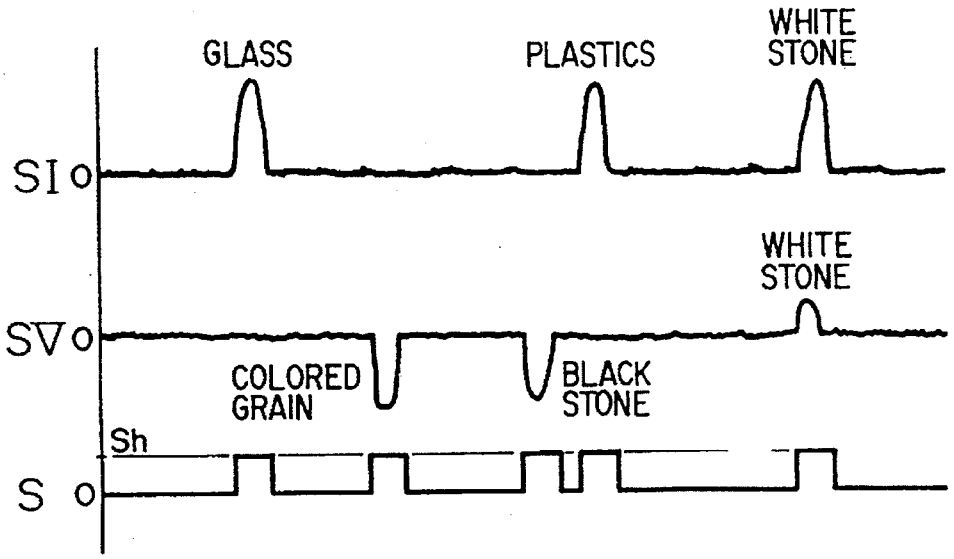
FIG. 6 is a time chart (graph) showing waveforms of output signals from components shown in FIG. 5.

Next, operation of the thus-constructed cereal grain color sorting apparatus 50 will be described with reference to FIGS. 1 and 6. A switch on the control panel 12 is turned ON, and the grain is filled in the raw grain tank 2 through a chute pipe of a bucket elevator which is not shown, and the vibrating feed trough 3 is driven. Then, the grain falls from the left end of the trough 3 into the downward chute 5 and successively slides down along the bottom surface of the downward chute 5 to be transferred from the lower end of the downward chute 5 to the detecting position F.

The grain transferred to the detecting position F is illuminated by the illuminating means disposed in the optical detection boxes 14, 16 and comprising the fluorescent lamps 18, 22 and the halogen lamps 19, 23. The intensity of light reflected from and transmitted through the grain illuminated by the fluorescent lamps 18, 22 is detected by the silicon photosensor 13 through the visible light-pass optical filter 17*a*, while the intensity of light reflected from and transmitted through the grain illuminated by the halogen lamps 19, 23 is detected by the germanium photosensor 15 through the near-infrared light-pass optical filter 21*a*.

The silicon photosensor 13 constantly monitors the background 24 the angle of rotation of which about the shaft 24*a* has been adjusted beforehand so as to have the same brightness as the good grain (good white rice grain) in the visible light region. FIG. 6 is a graph showing waveforms of the output signals SI, SV and S from the sensors 15, 13 and the signal processor 27. The output signal SV from the silicon photosensor 13 is changed a little at the time when the good grain (good white rice grain) passes through the detecting position F but it is changed much greater at the time when the granular object to be separated or removed, which can be discriminated by the light in the visible light region, such as colored grain, black stone or the like passes therethrough. Accordingly, based on the output signal SV from the silicon photosensor 13, the good grain (good white rice grain) can be detected and discriminated from the foreign matter such as colored grain, black stone or the like in terms of the difference in brightness in the visible light region.

Even in the case that the signal SV of the silicon photosensor 13 is not changed, there is a possibility that the good grain is mixed with the foreign matter which has the same color as the good grain or which is transparent (such as white stone, glass piece, plastic piece or the like). The germanium photosensor 15 constantly monitors the background 20 the angle of rotation of which about the shaft 20*a* has been adjusted beforehand so as to have the same brightness as the good grain (white rice) in the near-infrared region. The output signal SI of the germanium photosensor 15 is changed a little at the time when the good grain (good white rice grain) passes through the detecting position F but it is changed much greater at the time when the granular object to be separated or removed, which can be discriminated in the near-infrared light region, such as glass piece, plastic piece, white stone or the like passes therethrough. Accordingly, based on the output signal SI from the germanium photosensor 15, the good grain (good white rice grain) can be detected and discriminated from the foreign matter such as glass piece, plastic piece or the like in terms of the difference in brightness in the near-infrared region (see FIG. 6).

The output signals SV and SI from the silicon photosensor 13 and the germanium photosensor 15 are given to the signal processor 27 where they are amplified, compared and computed to generate the sorting or discrimination signal S. When the sorting signal S is at a high level Sh, the signal S causes the ejector valve 8 to operate to jet the compressed air from the nozzle exit.

The compressed air effects the separation and removal of the grain or foreign matter of different color or the foreign matter of the same color as the good grain or transparent by blowing off the same out of the good grain (good white rice grain). The blown-off grain of different color or foreign matter is transferred from the reject discharge port 10 to the conveyor means 29 so as to be discharged to the outside of the apparatus 50.

On the other hand, the good grain (good white rice grain), which does not cause the sorting signal S at the high level Sh to be produced even when passing through the detecting position F, is transferred to the receiving chute 7 so as to be discharged by the conveyor means 30 to the outside of the apparatus 50 as the product.

In the present embodiment, the grain feed means and the grain guide means have been described as comprising the vibrating feed trough, the downward chute and the like, and however, these are not limitative. In case of sorting beans, a belt type grain feed means may be used for the grain feed means.

Further, the above description has been made about the case in which the grain to be sorted is white rice grain, and however, the good grain to be sorted may be brown rice grain (unpolished or not-milled rice grain), unpolished (not-milled) or polished (milled) wheat grain, or beans, instead of white or whitened rice grain. Incidentally, the wavelength bands in the visible light region and in the near-infrared region, which are suitable for discrimination from the foreign matter, may be selected according to kind and state (milled, not milled or the like) of the grain, and the first and second light sources and the first and second light-receiving sensor portions may be selected according to the selected wavelength bands. Under certain circumstances, only the filters to be attached in front of the respective light-receiving sensor portions may be changed while leaving the light sources and the light-receiving sensor portions unchanged. It is noted that, when the emission spectrum of the light source is narrow or when the detectable spectral band of the light-receiving sensor portion is narrow, the filter may be dispensed with.

Various means, referred to herein such as the grain grain guide means, optical detecting means, illustrating means, light-receiving sensor means, background means and ejector means may be constituted wholy or partially by corresponding component(s) for the conventional apparatuses or devices known, for example, in U.S. Pat. Nos. 4,344,539, 4,235,342, 4,168,005, 4,096,949, 4,088,227, 3,930,991, 3,890,221 and 3,800,147 which are incorporated herein by reference thereto, so long as the sprit of the invention in maintained.

What is claimed is:

1. A cereal grain color sorting apparatus comprising:

grain guide means for guiding the grain along a predetermined grain flow path to a predetermined detecting position;

grain feed means for feeding the grain successively to said grain guide means;

optical detecting means for detecting an abnormal grain among the grain fed from the grain guide means and passed along a grain flow path through the predetermined detecting position; and ejector means, located downstream from said optical detecting means, for directing fluid to remove the grain detected as being abnormal;

wherein said optical detecting means comprises a pair of source-background assemblies opposed to each other with the predetermined position situated therebetween, each source-background assembly including:

a box a visible light source mounted on the box, a near-infrared source mounted on the box, and a background means mounted on the box for diffusely reflecting an incident light, an arrangement of the visible light source, near-infrared source and background means in the box in one of the pair of source-background assemblies being identical with an arrangement of the visible light source, near-infrared source and background means in the box in another of the pair of source-background assemblies, said optical detecting means further comprises a visible light sensor portion mounted on the box of said one source-background assembly, and a near-infrared sensor portion mounted on the box of said another source-background assembly, the arrangement of the source-background assemblies and visible light and near-infrared sensor portions being such that visible light from the visible light source of said one source-background assembly is reflected by the grain passing through the predetermined position to be received by the visible light sensor portion mounted on the box of said one source-background assembly, infrared light from the near-infrared source of said another source-background assembly is reflected by the grain passing through the predetermined position to be received by the near-infrared sensor position mounted on the box of said another source-background assembly, visible light from visible light source of said another source-background assembly is diffusely reflected by the background means of said another source-background assembly to be received by the visible light sensor portion mounted on the box of said one source-background assembly, an intensity of visible light, from the background means of said another source-background assembly, received by the visible light sensor portion being substantially the same as an intensity of visible light, issued from the visible light source of said one source-background assembly and reflected by a normal grain, received by the visible light sensor portion, and near-infrared light from the near-infrared source of said one source-background assembly is diffusely reflected by the background means of said one source-background assembly to be received by the near-infrared sensor portion mounted on the box of said another source-background assembly, and intensity of near-infrared light, from the background means of said one source-background assembly, received by the near-infrared light sensor portion being substantially the same as an intensity of near-infrared light, issued from the near infrared source of said another source-background assembly and reflected by a normal grain, received by the near-infrared sensor portion.

2. A cereal grain color sorting apparatus according to claim 1, wherein said visible first light source comprises a fluorescent lamp producing the light in the visible light region, said near-infrared source comprises a halogen lamp producing the light in the near-infrared region, said visible light sensor portion comprises a silicon photosensor and said near-infrared sensor portion comprises a germanium photosensor.

3. An apparatus according to claim 1, wherein said visible and near-infrared sensor portions have filters which allow the light in the visible light region and the light in the near-infrared region to be transmitted therethrough, respectively.

4. An apparatus according to claim 3, wherein said filter of said near-infrared sensor portion selectively allows the light of a wavelength band of 1,400–1,600 nm to be transmitted therethrough.

5. A cereal grain color sorting apparatus comprising:

grain guide means for guiding the grain along a predetermined grain flow path to a predetermined detecting position;

grain feed means for feeding the grain successively to said grain guide means;

optical detecting means for detecting an abnormal grain among the grain fed from the grain guide means and passed along a grain flow path through the predetermined detecting position; and ejector means, located downstream from said optical detecting means, for directing fluid to remove the grain detected as being abnormal;

wherein said optical detecting means comprises a pair of source-background assemblies opposed to each other with the predetermined position situated therebetween, each source-background assembly including:

a visible light source, a near-infrared source, and a background means for diffusely reflecting an incident light, an arrangement of the visible light source, near-infrared source and background means in one of the pair of source-background assemblies being identical with an arrangement of the visible light source, near-infrared source and background means in another of the pair of source-background assemblies, said optical detecting means further comprises a visible light sensor portion of said one source-background assembly, and a near-infrared sensor portion of said another source-background assembly, the arrangement of the source-background assemblies and visible light and near-infrared sensor portions being such that visible light from the visible light source of said one source-background assembly is reflected by the grain passing through the predetermined position to be received by the visible light sensor portion of said one source-background assembly, infrared light from the near-infrared source of said another source-background assembly is reflected by the grain passing through the predetermined position to be received by the near-infrared sensor position of said another source-background assembly.

* * * * *